US010107042B2

(12) United States Patent
Yu et al.

(10) Patent No.: US 10,107,042 B2
(45) Date of Patent: Oct. 23, 2018

(54) ULTRA-HARD CONSTRUCTIONS WITH EROSION RESISTANCE

(71) Applicant: SMITH INTERNATIONAL, INC., Houston, TX (US)

(72) Inventors: Feng Yu, Lindon, UT (US); Benjamin Randall, Spanish Fork, UT (US); Haibo Zhang, Lindon, UT (US); J. Daniel Belnap, Lindon, UT (US)

(73) Assignee: SMITH INTERNATIONAL, INC., Houston, TX (US)

( * ) Notice: Subject to any disclaimer, the term of this patent is extended or adjusted under 35 U.S.C. 154(b) by 298 days.

(21) Appl. No.: 14/019,394

(22) Filed: Sep. 5, 2013

(65) Prior Publication Data

US 2014/0069725 A1 Mar. 13, 2014

Related U.S. Application Data

(60) Provisional application No. 61/698,402, filed on Sep. 7, 2012.

(51) Int. Cl.
*E21B 10/50* (2006.01)
*B22F 3/15* (2006.01)
(Continued)

(52) U.S. Cl.
CPC ..... *E21B 10/5735* (2013.01); *B22F 3/15* (2013.01); *C22C 26/00* (2013.01); *E21B 10/46* (2013.01);
(Continued)

(58) Field of Classification Search
CPC ..... E21B 10/5735; E21B 10/55; E21B 10/46; E21B 10/573; E21B 2010/564; E21B 2010/565
See application file for complete search history.

(56) References Cited

U.S. PATENT DOCUMENTS 4,224,380 A 9/1980 Bovenkerk et al.
4,699,227 A 10/1987 Wardley
(Continued)

FOREIGN PATENT DOCUMENTS

CN 2906032 Y 5/2007
CN 102174877 A 9/2011
(Continued)

OTHER PUBLICATIONS

International Search Report and Written Opinion issued in PCT/US2013/058411 dated Nov. 22, 2013, 14 pages.
(Continued)

*Primary Examiner* — Jennifer H Gay

(57) ABSTRACT

Ultra-hard constructions comprise polycrystalline diamond-body having a first metallic substrate attached thereto, and having a second metallic substrate attached to the first metallic substrate. The first and second substrates each comprise a first hard particle phase, e.g., WC, and a second binder material phase, e.g., Co, wherein the hard particles in the second substrate are sized larger than those in the first substrate. The first substrate may contain a larger amount of binder material than the second substrate. Constructed in this matter, the first substrate is engineered to facilitate sintering diamond body during HPHT conditions, while the second substrate is engineered to provide an improved degree of erosion resistance when placed in an end-use application. The construction may be formed during a single HPHT process. The second substrate may comprise 80 percent or more of the combined thickness of the first and second substrates.

20 Claims, 4 Drawing Sheets

(51) Int. Cl.

| | |
|---|---|
| ***C22C 26/00*** | (2006.01) |
| ***E21B 10/573*** | (2006.01) |
| ***E21B 10/55*** | (2006.01) |
| ***E21B 10/46*** | (2006.01) |
| *B22F 5/00* | (2006.01) |
| *B22F 7/06* | (2006.01) |

(52) U.S. Cl.
CPC ..... *E21B 10/55* (2013.01); *B22F 7/062* (2013.01); *B22F 2005/001* (2013.01); *B22F 2999/00* (2013.01)

(56) References Cited

U.S. PATENT DOCUMENTS

| | | | | |
|---|---|---|---|---|
| 5,348,109 | A | 9/1994 | Griffin | |
| 6,065,554 | A * | 5/2000 | Taylor | E21B 10/5673 175/430 |
| 6,077,591 | A * | 6/2000 | Griffin | B23B 27/145 175/428 |
| 6,248,477 | B1 | 6/2001 | Howard, Jr. et al. | |
| 7,350,601 | B2 * | 4/2008 | Belnap | B22F 7/06 175/374 |
| 7,462,003 | B2 | 12/2008 | Middlemiss | |
| 7,726,421 | B2 | 6/2010 | Middlemiss | |
| 7,757,791 | B2 | 7/2010 | Belnap et al. | |
| 8,061,454 | B2 * | 11/2011 | Voronin | B22F 7/062 175/426 |
| 8,440,303 | B2 * | 5/2013 | Mukhopadhyay | B01J 3/062 428/408 |
| 8,590,130 | B2 * | 11/2013 | Zhang | B22F 7/062 29/402.09 |
| 8,882,869 | B2 * | 11/2014 | DiGiovanni | E21B 10/5735 175/434 |
| 8,925,656 | B2 * | 1/2015 | Shen | B22F 7/06 175/420.2 |
| 2001/0008190 | A1 | 7/2001 | Scott et al. | |
| 2004/0007394 | A1 * | 1/2004 | Griffin | E21B 10/573 175/434 |
| 2006/0162969 | A1 | 7/2006 | Belnap et al. | |
| 2007/0079994 | A1 * | 4/2007 | Middlemiss | C04B 35/52 175/426 |
| 2009/0305039 | A1 | 12/2009 | Sumiya | |
| 2010/0282519 | A1 * | 11/2010 | Zhang | B22F 7/062 175/434 |
| 2010/0314176 | A1 * | 12/2010 | Zhang | E21B 10/573 175/383 |
| 2011/0061944 | A1 | 3/2011 | Scott et al. | |
| 2011/0067929 | A1 * | 3/2011 | Mukhopadhyay | B01J 3/062 175/432 |
| 2011/0067930 | A1 | 3/2011 | Beaton | |
| 2011/0073379 | A1 | 3/2011 | DiGiovanni et al. | |
| 2011/0083908 | A1 | 4/2011 | Shen et al. | |
| 2011/0083909 | A1 | 4/2011 | Shen et al. | |
| 2011/0114394 | A1 | 5/2011 | Lockwood et al. | |
| 2011/0171414 | A1 | 7/2011 | Sreshta et al. | |
| 2011/0297453 | A1 | 12/2011 | Mukhopadhyay et al. | |
| 2012/0055716 | A1 | 3/2012 | Martensson et al. | |
| 2012/0080239 | A1 * | 4/2012 | Lyons | E21B 10/5735 175/428 |
| 2012/0225253 | A1 | 9/2012 | DiGiovanni et al. | |
| 2013/0168159 | A1 * | 7/2013 | Eyre | E21B 10/46 175/432 |
| 2014/0069725 | A1 * | 3/2014 | Yu | E21B 10/5735 175/428 |

FOREIGN PATENT DOCUMENTS

| | | | |
|---|---|---|---|
| WO | 2004007901 | A1 | 1/2004 |
| WO | 2011098559 | A1 | 8/2011 |

OTHER PUBLICATIONS

CN Second Office Action for Application No. 201380086087.7, dated Sep. 5, 2016. (20 pgs).

International Preliminary Report on Patentability issued in International patent application PCT/US2013/058411 dated Mar. 19, 2015. 11 pages.

Supplementary Search Report issued in European patent application 13835247.1 dated Oct. 16, 2015. 3 pages.

Examination Report issued in European patent application 13835247.1 dated Oct. 29, 2015. 7 pages.

Third Office Action issued in Chinese patent application 20138/0056057.7 dated Apr. 5, 2017. 23 pages.

Fourth Office Office Action issued in Chinese patent application 20138/0056057.7 dated Oct. 10, 2017. 12 pages.

First Office Office Action issued in Chinese patent application 20138/0056057.7 dated Dec. 28, 2015. 20 pages.

* cited by examiner

ULTRA-HARD CONSTRUCTIONS WITH EROSION RESISTANCE

CROSS-REFERENCE TO RELATED APPLICATIONS

This application claims the benefit of U.S. Provisional Patent Application Ser. No. 61/698,402 filed on Sep. 7, 2012, which is incorporated herein by reference in its entirety.

BACKGROUND

The use of ultra-hard constructions comprising a body formed from ultra-hard materials such as diamond, polycrystalline diamond (PCD), cubic boron nitride (cBN), polycrystalline cubic boron nitride (PcBN) are well known in the art. An example of such constructions may be found in the form of cutting elements comprising an ultra-hard component or body that is joined to a metallic component or substrate. In such cutting elements, the wear or cutting portion is formed from the ultra-hard component and the metallic portion is provided for the purpose of attaching the cutting element to a desired wear and/or cutting device. In such known constructions, the ultra-hard component may be formed from those ultra-hard materials described above that provide a high level of wear and/or abrasion resistance that is greater than that of the metallic component.

The use of PCD as an ultra-hard material for forming such constructions is well known in the art. PCD is formed by subjecting a volume of diamond grains to high-pressure/high-temperature (HPHT) conditions in the presence of a suitable catalyst material, such as a solvent catalyst metal selected from Group VIII of the Periodic table. Oftentimes, the source of the solvent catalyst material used to form PCD is the metallic substrate, wherein the solvent catalyst material is present as a constituent of the substrate that migrates therefrom and infiltrates into the adjacent diamond body during HPHT processing. The resulting construction is a PCD compact comprising the PCD body joined to the substrate.

Over the years, improvements have been made to the PCD body portion of such ultra-hard constructions in terms of providing enhanced properties of thermal stability, wear resistance and abrasion resistance, thereby extending the effective service life of such ultra-hard constructions to the point where other elements of the construction now operate to govern service life. For example, it has been discovered that the substrate component of such ultra-hard constructions, because they are subjected to extended service life by virtue of the improved PCD body, suffer erosion damage due to long exposure down hole when subjected to extended exposure to the drilling debris and the mud jets during a drilling operation. This erosion damage ultimately results in the failure of the ultra-hard construction, thereby effectively limiting service life.

SUMMARY

Ultra-hard constructions as disclosed herein comprise diamond-body comprising a matrix phase of intercrystalline bonded diamond, and a plurality of interstitial regions dispersed within the matrix phase. The construction includes a first metallic substrate attached to the diamond body, and a second metallic substrate attached to the first metallic substrate. The first and second substrates are selected from the groups consisting of metallic materials, ceramic materials, cermet materials and combinations of the same. The first and second substrates each comprise a first hard particle phase and a second binder material phase. The second metallic substrate comprises hard particles having an average particle size that is different from that of the hard particles in the first substrate. The first substrate has a material composition that facilitates sintering of the diamond body during high-pressure/high-temperature conditions, and the second substrate has a material composition having a greater degree of erosion resistance when placed in an end-use application as compared to the first substrate. In an example embodiment, the diamond body is formed during a high-pressure/high-temperature process, and during such process both the first substrate is integrally attached to the diamond body, and the second substrate is attached to the first substrate. The first substrate may comprise an amount of binder material that is greater than the amount of the binder material in the second substrate. In example embodiment, the first substrate has a thickness that is less than about ½ the thickness of the diamond body, and in other embodiments less than about ¼ the thickness of the diamond body. This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

Embodiments of ultra-hard constructions are described with reference to the following figures.

DETAILED DESCRIPTION

Figure 1:
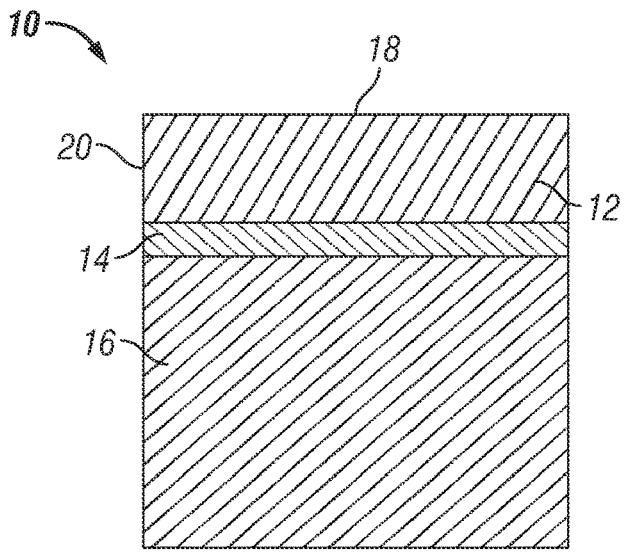
FIG. 1 is a cross sectional side view of an example embodiment ultra-hard construction as disclosed herein.

Ultra-hard constructions as disclosed herein comprise a diamond-bonded body formed from polycrystalline diamond (PCD). The diamond-bonded body may include a region of thermally stable polycrystalline diamond (TSP), wherein such region may or may not comprise an infiltrant material. The ultra-hard constructions comprise an infiltration substrate joined to the diamond-bonded body, and a service substrate that is bonded to the infiltration substrate, wherein the service substrate is specifically engineered having a material composition designed to provide improved erosion resistance when compared to conventional substrates used in conjunction with conventional PSD constructions.

While the body has been described above as being a diamond-bonded body, it is to be understood that the body may be formed from ultra-hard materials other than diamond. As used herein, the term "ultra-hard" is understood to refer to those materials known in the art to have a grain hardness of about 4,000 HV or greater. Such ultra-hard materials may include those capable of demonstrating physical stability at temperatures above about 750° C., and for certain applications above about 1,000° C., that are formed from consolidated materials. Such ultra-hard materials may include but are not limited to diamond, cubic boron nitride (cBN), diamond-like carbon, boron suboxide, aluminum manganese boride, and other materials in the boron-nitrogen-carbon phase diagram which have shown hardness values similar to cBN and other ceramic materials.

PCD is an ultra-hard material formed in the manner noted above by subjecting a volume of diamond grains to HPHT conditions in the presence of a catalyst material. The catalyst material may be a solvent catalyst metal, such as one or more selected from Group VIII of the Periodic table. As used herein, the term "catalyst material" refers to the material initially used to facilitate diamond-to-diamond bonding or sintering during the HPHT conditions used to form the PCD. PCD has a material microstructure comprising a matrix phase of intercrystalline bonded diamond, and a plurality of interstitial regions dispersed within the matrix phase, wherein the catalyst material is disposed within the interstitial regions.

TSP is formed by removing the catalyst material from PCD, so that the remaining diamond structure is substantially free of the catalyst material. TSP has a material microstructure characterized by a matrix phase of intercrystalline bonded diamond, and a plurality of empty interstitial regions. If desired, the empty interstitial regions may be filled with a desired replacement or infiltrant material as described below. The TSP may comprise the catalyst material that has been treated to prevent it from acting in a catalytic manner when the diamond body is subjected to high temperature conditions. TSP may also include diamond grains sintered using non-metallic thermally stable solvent catalysts such as carbonates, oxides and sulfides. The TSP may also be 100% diamond material synthesized with CVD or directly synthesized from graphitic sources. The TSP sources may be employed as previously synthesized material.

Diamond grains useful for forming the diamond-bonded body may include natural and/or synthetic diamond powders having an average diameter grain size in the range of from submicrometer in size to 100 micrometers, and in the range of from about 1 to 80 micrometers. The diamond powder may contain grains having a mono or multi-modal size distribution. In an example embodiment, the diamond powder has an average particle grain size of approximately 20 micrometers. In the event that diamond powders are used having differently sized grains, the diamond grains are mixed together by conventional process, such as by ball or attritor milling for as much time as necessary to ensure good uniform distribution.

The diamond grain powder is cleaned, to enhance the sinterability of the powder by treatment at high temperature, in a vacuum or reducing atmosphere. The diamond powder mixture is loaded into a desired container for placement within a suitable HPHT consolidation and sintering device.

During the HPHT process, a catalyst material, e.g., a solvent metal catalyst, or the like, is combined with the diamond powder. In an embodiment, the catalyst material is provided by infiltration from a desired substrate, i.e., an infiltration substrate, that is positioned adjacent the diamond powder prior to HPHT processing and that includes the catalyst material as a constituent material. Suitable substrates useful for as a source for infiltrating the catalyst material may include those used to form conventional PCD materials, and may be provided in powder, green state and/or already sintered form. A feature of such substrate is that it includes a metal solvent catalyst that is capable of melting and infiltrating into the adjacent volume of the diamond powder to facilitate bonding the diamond grains together during the HPHT process. In an example embodiment, the catalyst material is Co, and a substrate useful for providing the same is a cobalt containing substrate, such as WC—Co.

Substrate materials useful for serving as the infiltrant substrate include those conventionally used for infiltrating and forming PCD materials, which include metallic materials, ceramic materials, cermet materials, and combinations thereof. Example infiltration substrates may be formed from hard materials like carbides such as WC, $W_2C$, TiC, VC, or ultra-hard materials such as synthetic diamond, natural diamond and the like, wherein the hard or ultra-hard materials may include a softer binder phase comprising one or more Group VIII material such as Co, Ni, Fe, and Cu, and combinations thereof. A feature of such infiltration substrate is that it has a material composition that operates to ensure its ability to release its binder phase material and infiltrate into the diamond powder during the HPHT process.

In an example embodiment, the initial substrate may be formed from WC—Co comprising a WC hard material with a particle size greater than about 1 microns, and in the range of from about 1 to 5 microns, and having a Co content greater than about 9 percent by weight, and in the range of from about 12 to 14 percent by weight based on the total weight of the WC—Co material. In an embodiment, the initial substrate is formed from WC—Co comprising a WC particle size of about 2 microns and having a Co content of about 13 percent by weight prior to sintering of the diamond body.

A feature of ultra-hard constructions as disclosed herein is they include two substrates; namely an infiltration substrate and a service substrate. The infiltration substrate is used to provide the source of catalyst material useful to sinter and form the PCD body during the HPHT process. Accordingly, such infiltration substrate is specially engineered in terms of material composition and in terms of quantity, size or amount to provide this function. The initial substrate is not developed to provide improved erosion resistance, which property (in addition to providing an attachment element with an end-use device) is provided by the service substrate.

Thus, the size, amount or quantity of the infiltration substrate is ideally no more than that needed to provide a desired amount of the catalyst material to the adjacent diamond powder during HPHT processing to promote diamond bonding and the formation of a fully-sintered PCD body. Thus, generally speaking, the volume of the initial substrate used to form ultra-hard construction as disclosed herein is no more than needed to accomplish this function. In an example embodiment, where the diamond powder volume is about 0.5 ml, the volume of the initial substrate material may be in the range of from about 0.12 to 0.25 ml. It is understood that these ranges are provided for purposes of reference and example, and that the exact amount of initial substrate material that is used can and will vary depending such factors as the volume of the diamond powder, the desired diamond content of the resulting PCD body, and the volume content of the catalyst material in the initial substrate.

In an example embodiment ultra-hard construction where the PCD body has a diameter of approximately 16 mm, and a thickness of approximately 2.5 mm, the initial substrate may have the same diameter and a thickness in the range of from about 0.7 to 1.2 mm. Generally, it is desired that the initial substrate have a thickness that is no greater than about ½ the thickness of the PCD body, and less than about ¼ the thickness of the PCD body.

While the infiltration substrate has been described above as providing a source of catalyst material for infiltration and sintering of the PCD body, that infiltration substrate may have a level of catalyst material, e.g., cobalt, insufficient by itself to provide a desired level of infiltration and sintering. In this example embodiment, the infiltration substrate may comprise a lower level of the catalyst material than disclosed above, and act as a sieve through which a catalyst material migrates therethrough and into the diamond powder from the underlying service substrate during the sintering process.

Another feature of the initial substrate and PCD body is that they have an interface that has been engineered to provide optimized residual stress distribution, thereby providing enhanced resistance to delamination during use. In an example embodiment, the desired optimized stress distribution obtained by configuring initial substrate interface surface of the PDC body to have increased thickness running along an outside diameter, and a relatively lower thickness along an inside diameter. This feature operates to reduce the tensile residual stresses which are exposed at the outside diameter and can cause premature delamination of the PCD body.

Figure 8A:
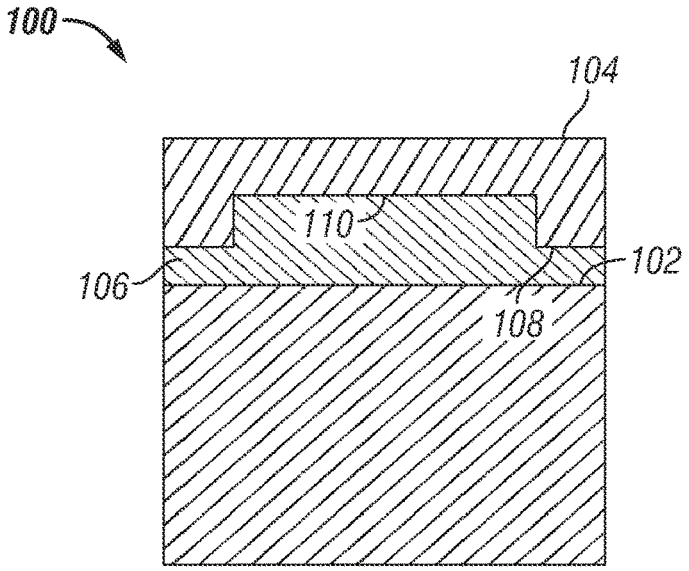
FIGS. 8*a* and 8*b* are cross-sectional side views of example embodiment ultra-hard constructions as disclosed herein showing different PCD body interface configurations.
Figure 8B:
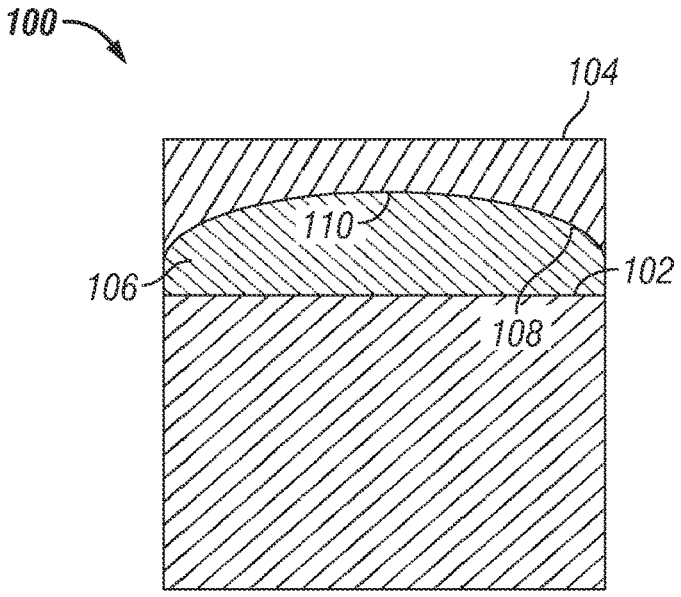

FIGS. 8*a* and 8*b* each illustrate example embodiment ultra-hard constructions 100 as disclosed herein comprising an interface 102 between the PCD body 104 and the initial substrate 106 that has been configured in the manner described above to reduce tensile residual stresses. Specifically, FIG. 8*a* illustrates an ultra-hard construction 100 comprising a PCD body 102 having a relatively thicker outside diameter section 108 and a relatively thinner inside diameter section 110, wherein the transition between the two diameter sections is stepped and not gradient, and wherein the interface surface of the initial substrate 106 is configured to complement the shape of the PCD body. Specifically, FIG. 8*b* illustrates an ultra-hard construction 100 comprising a PCD body 102 having a relatively thicker outside diameter section 108 and a relatively thinner inside diameter section 110, wherein the transition between the two diameter sections is a gradient and not stepped, and wherein the interface surface of the initial substrate 106 is configured to complement the shape of the PCD body.

The service substrate is one that is specially engineered to both provide a strong attachment bond with the infiltration substrate and provide an improved degree of erosion resistance when the ultra-hard construction is placed into service. Substrate materials useful for serving as the service substrate include metallic materials, ceramic materials, cermet materials, and combinations thereof. Example service substrates include those formed from hard materials like carbides such as WC, $W_2C$, TiC, VC, or ultra-hard materials such as synthetic diamond, natural diamond and the like, wherein the hard or ultra-hard materials may include a softer binder phase comprising one or more Group VIII material such as Co, Ni, Fe, and Cu, and combinations thereof.

In an example embodiment, the service substrate is engineered having a material composition having an improved degree of erosion resistance when compared to conventional substrates used to for conventional PCD constructions. In an example embodiment, such enhanced erosion resistance may be provided from a material construction comprising an increased proportion of the hard material, or a reduced proportion of the binder phase material, than that of the infiltrant substrate. For example, when the service substrate material phase selected is WC—Co, such WC—Co may comprise less than about 11 percent by weight of the Co, and in the range of from around 6 to 10 percent by weight of the Co based on the total weight of the WC—Co.

In another example embodiment, such enhanced erosion resistance may be provided from a material construction comprising a hard phase material having an increased particle size when compared to that of the hard phase material used in the infiltrant substrate. For example, when the service substrate material phase selected is WC—Co, such WC—Co may have an average particle grain size of greater than about 10 microns, and in some cases greater than about 20 microns. In an example embodiment, where WC—Co is selected as the service substrate material, the WC phase may have an average particle size in the range of from about 10 to 30 microns, and in the range of from about 15 to 25 microns.

In another example embodiment, the service substrate may be formed having a very large-grained hard phase material, e.g., WC—Co, which is similar to the sizes used in matrix powders for PDC bit bodies. In such example embodiment, the hard phase material may have an average particle size of greater than about 325 mesh or 44 microns, and in some embodiments even greater than about 60 mesh or 250 microns. In the case of these very large-grain size materials, the binder or Co content may be greater than the service substrate embodiments described above. For example, for such very large-grain size materials may have a Co content in the range of from about 6 to 14 percent by weight.

In still another example embodiment, such enhanced erosion resistance may be provided from a material construction comprising a combination of coarse hard phase material, e.g., WC, and a relatively low proportion of the binder material, e.g., Co. For example, when the service substrate material selected is WC—Co, such material may have a material composition comprising WC having an average particle grain size as described above, and having a Co content as described above.

Conventionally, service substrates comprising the material compositions described above are not well suited for either serving as an infiltration source for forming a sintered PCD body, or for bonding directly to the PCD body. Accordingly, the infiltration substrate operates to serve these purposes, and the service substrate forms a strong bond with the infiltrant substrate during HPHT processing.

The diamond powder or green-state part is loaded into a desired container with the infiltrant substrate positioned adjacent the diamond posed, and the service substrate positioned adjacent the infiltrant substrate, and the container is positioned within a suitable HPHT consolidation and sintering device. The HPHT device is activated to subject the container to a desired HPHT condition to effect consolidation and sintering of the diamond powder, the attachment of the infiltrant substrate to the so-formed PCD body, and attachment of the service substrate to the infiltrant substrate. In an example embodiment, the device is controlled so that the container is subjected to a HPHT process having a pressure of 5,000 MPa or greater and a temperature of from about 1,350° C. to 1,500° C. for a predetermined period of time. At this pressure and temperature, the catalyst material within the infiltrant substrate melts and infiltrates into the diamond powder mixture, thereby sintering the diamond grains to form PCD.

After the HPHT process is completed, the container is removed from the HPHT device, and the so-formed ultra-hard construction is removed from the container. A feature of ultra-hard constructions as disclosed herein is that infiltration and service substrates are attached to one another, and the infiltration substrate is attached to the PCD body, during the same HPHT process as used to form the PCD body, thereby avoiding the need for any subsequent attaching step.

FIG. 1 illustrates an example embodiment ultra-had construction 10 prepared in the manner described above, comprising a PCD body 12, an initial or infiltration substrate 14, and a final or service substrate 16 that are each attached to one another during the HPHT process used to form the PCD body. As noted above, the initial substrate 14 is selected for the purpose of introducing a desired catalyst material into the diamond volume during the HPHT process to facilitate desired sintering, and for this purpose has a reduced thickness as compared to substrates in conventional PCD constructions. In an example embodiment, it is desired that infiltrant substrate be reduced to about 20 percent or less of the thickness of a conventional substrate used to form a conventional PCD construction.

Interfaces surfaces between the PCD body 12 and the infiltration substrate 14 and/or between the infiltration substrate 14 and the service substrate 16 may be planar or nonplanar. In an end-use application calling for a high degree of delamination resistance, a nonplanar interface may be desired to provide an enhanced degree of attachment strength between the infiltration substrate and the service final substrate. A construction comprising nonplanar interfaces both between the diamond body and the infiltration substrate, and the initial substrate and the final substrate may provide a further degree of enhanced resistance against unwanted delamination during use.

The PCD body 12 includes top and side surfaces 18 and 20 that may or may not be working surfaces. If desired, the PCD body 12 may have a beveled edge running between the top and side surfaces. The PCD body may be configured having a desired form for a particular end-use application without any further shaping or sizing. The PCD body may initially be configured having a form that facilitates HPHT processing, and then be subsequently shaped or sized as desired for use in the end-use application.

If desired, the diamond bonded body may be treated to remove at least a portion of the catalyst material disposed therein, thereby providing a resulting diamond body having improved properties of thermal stability, i.e., having a TSP portion. The particular end-use application will influence the extent and location of catalyst material removed from the diamond bonded body. The term "removed," as used with reference to the catalyst material is understood to mean that a substantial portion of the catalyst material no longer resides within the treated region of the diamond body. However, it is to be understood that some small amount of catalyst material may still remain in the part, e.g., within the interstitial regions and/or adhered to the surface of the diamond crystals. Additionally, the term "substantially free," as used herein to refer to the catalyst material in the treated region of the diamond body, is understood to mean that there may still be some small/trace amount of catalyst material remaining within the treated diamond body as noted above.

In an example embodiment, the diamond bonded body may be treated to remove catalyst material by chemical treatment, such as by acid leaching or aqua regia bath, electrochemical treatment such as by electrolytic process, by liquid metal solubility, or by liquid metal infiltration that sweeps the existing catalyst material away and replaces it with another noncatalyst material during a liquid phase sintering process, or by combinations thereof. In an example embodiment, the catalyst material is removed from the diamond body by an acid leaching technique, such as that disclosed for example in U.S. Pat. No. 4,224,380. Accelerated catalyst removal techniques may be used that involved elevated temperature and/or elevated pressure and/or sonic energy and the like. The diamond bonded body may be subjected to such treatment before or after it is attached to the final substrate.

The treated region of the diamond bonded body comprises a material microstructure having a polycrystalline diamond matrix phase made up of a plurality of diamond grains or crystals that are bonded together, and a plurality of interstitial regions that are disposed between the matrix phase of bonded together diamond grains, and that exist as empty pores or voids within the material microstructure, as a result of the catalyst material being removed therefrom.

In an example embodiment, a partial region of the diamond body is treated and the treated region extends a desired depth from a surface, which may be a working surface or the bonding surface to the substrate, of the diamond bonded body. In an example embodiment, the depth of such treated region may be about 0.05 mm or less, or may be about 0.05 to 0.6 mm. The exact depth of the treated region will depend on the bonding process and/or end-use application.

Figure 2:
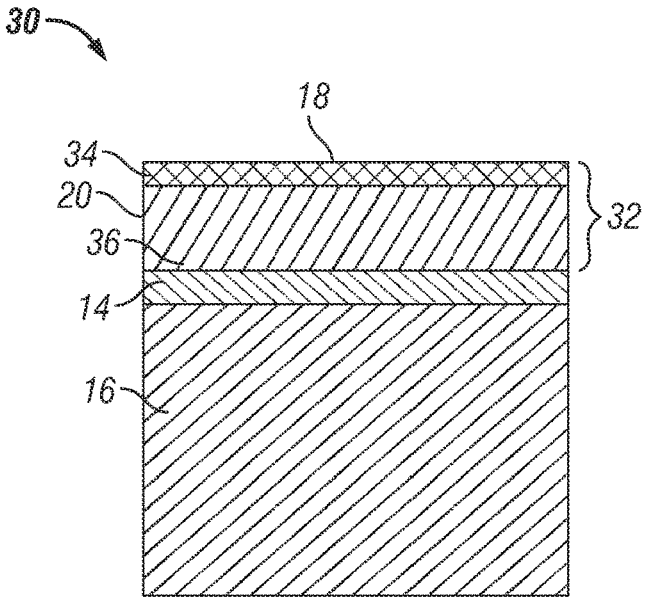
FIG. 2 is a cross sectional side view of another example embodiment ultra-hard construction.

FIG. 2 illustrates an example embodiment ultra-hard construction 30 as disclosed herein that has been treated in the manner described above. Specifically, this construction 30 comprises an ultra-hard body 32 a first or treated region 34 extending a depth from a working 18 surface that is substantially free of a catalyst material used to form the same, and a second remaining region 36 comprising the catalyst material that extends to the infiltration substrate 14. Like the construction embodiment described above and illustrated in FIG. 1, thus construction also comprises the infiltration substrate 14 and the service substrate 16.

If desired, the treated region of the diamond bonded body may be further treated so that all or a population of the interstitial regions within the part, previously empty by virtue of removing the catalyst material therefrom, are filled with a desired replacement or infiltrant material. In an example embodiment, such region may be filled, backfilled or reinfiltrated with a material that operates to minimize and/or eliminate unwanted infiltration of material from the final substrate, and/or that operates to improve one or more properties of the diamond bonded body.

Example replacement or infiltrant materials useful for treating the diamond bonded body may include materials selected from the group including metals, metal alloys, metal carbonates, carbide formers, i.e., materials useful for forming a carbide reaction product with the diamond in the body, and combinations thereof. Example metals and metal alloys include those selected from Group VIII of the Periodic table, examples carbide formers include those comprising Si, Ti, B and others known to produce a carbide reaction product when combined with diamond at HPHT conditions. The infiltrant material has a melting temperature that is within the diamond stable HPHT window, and may be provided in the form of a powder layer, a green state part, an already sintered part or a preformed film. The diamond bonded body may be infiltrated during a further HPHT process.

A feature of ultra-hard constructions as disclosed herein is that they make use of two different substrates that are each specifically engineered to perform a specific purpose, thereby avoiding having to use a single substrate having properties reflecting a compromise in the dual tasks that such substrate performs. Specifically, such ultra-hard constructions comprise an initial or infiltrant substrate that is specially engineered to provide an optimal amount of catalyst material by infiltration for diamond bonding during the HPHT process to form a fully-sintered PCD body, and do this without regard for the need to provide erosion resistance. Additionally, such ultra-hard constructions comprise a final or service substrate that is specially engineered to both bond with the infiltrant substrate during HPHT process, and provide an optimal degree of erosion resistance to the construction when placed into service, and do this without regard for the need to act as a source of catalyst material for diamond bonding during the HPHT process. Engineered in this matter, such ultra-hard constructions function to provide enhanced service life by providing an erosion resistance substrate that better matches the already improved service life realized by the PCD body.

Ultra-hard constructions as disclosed herein may be used in a number of different applications, such as tools for mining, cutting, machining, milling and construction applications, wherein properties of shear strength, thermal stability, wear and abrasion resistance, mechanical strength, and/or reduced thermal residual stress are highly desired. Such constructions are particularly well suited for forming working, wear and/or cutting elements in machine tools and drill and mining bits such as roller cone rock bits, percussion or hammer bits, diamond bits, and cutting elements such as inserts, shear cutters and the like used in subterranean drilling applications.

Figure 3:
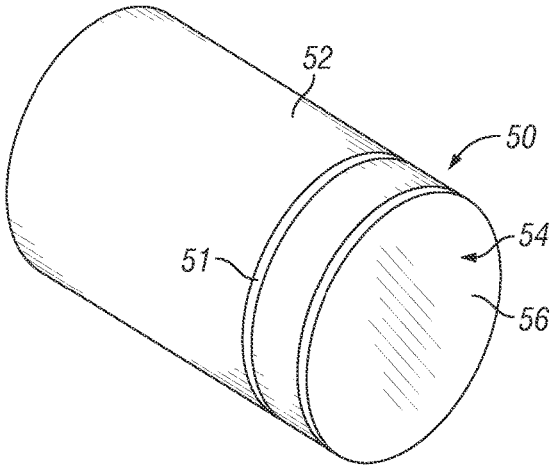
FIG. 3 is a perspective side view of an ultra-hard construction as disclosed herein embodied as a shear cutter.

FIG. 3 illustrates an ultra-hard construction as disclosed herein embodied in the form of a shear cutter 50 used, for example, with a drag bit for drilling subterranean formations. The shear cutter 50 comprises a diamond-bonded body 54 as described above. The diamond bonded body is attached to an infiltration substrate 51, which in turn is attached to a service substrate 52. The diamond-bonded body 54 includes a working or cutting surface 56.

Although the shear cutter in FIG. 3 is illustrated having a generally cylindrical configuration with a flat working surface that is disposed perpendicular to an axis running through the shear cutter, it is to be understood that shear cutters formed from ultra-hard constructions as disclosed herein may be configured other than as illustrated and such alternative configurations are understood to be within the scope of this disclosure.

Figure 4:
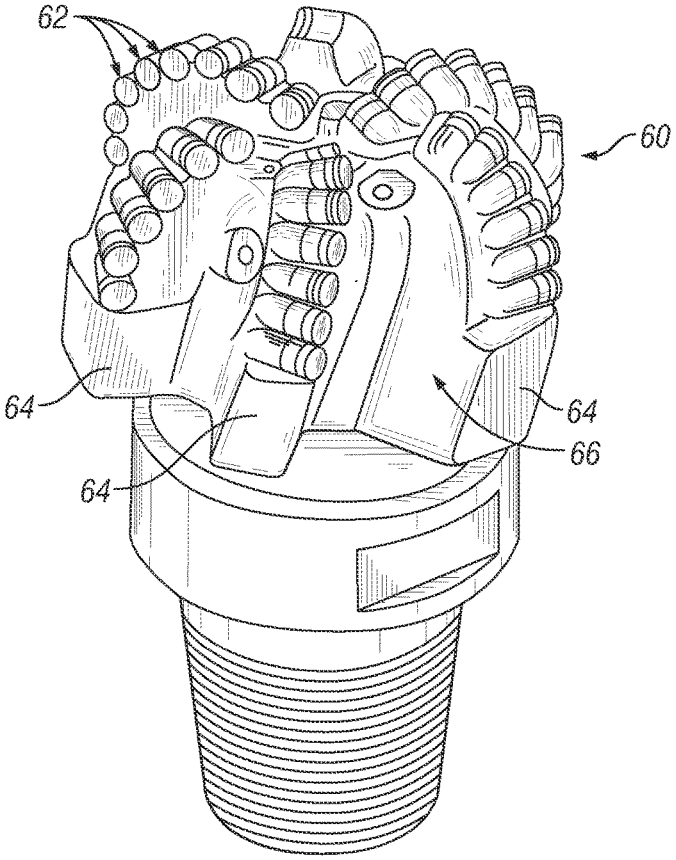
FIG. 4 is a perspective side view of a drag bit comprising a number of the shear cutters of FIG. 3.

FIG. 4 illustrates a drag bit 60 comprising a plurality of the shear cutters 62 described above and illustrated in FIG. 3. The shear cutters are each attached to blades 64 that each extend from a head 66 of the drag bit for cutting against the subterranean formation being drilled.

Figure 5:
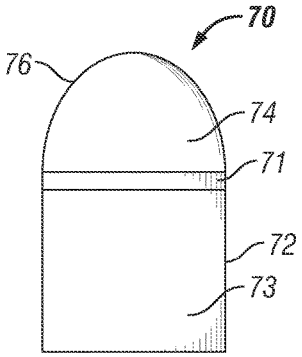
FIG. 5 is a perspective side view of an ultra-hard construction as disclosed herein embodied as an insert.

FIG. 5 illustrates an embodiment of an ultra-hard constriction as disclosed herein embodied in the form of an insert 70 used in a wear or cutting application in a roller cone drill bit or percussion or hammer drill bit used for subterranean drilling. For example, such inserts 70 may be formed from blanks comprising an infiltration substrate 71 and a service substrate 72, and a diamond-bonded body 74 having a working surface 76. The blanks are pressed or machined to the desired shape of a roller cone rock bit insert.

Although the insert in FIG. 5 is illustrated having a generally cylindrical configuration with a rounded or radiused working surface, it is to be understood that inserts formed from ultra-hard constructions as disclosed herein may be configured other than as illustrated, and such alternative configurations are understood to be within the scope of this disclosure.

Figure 6:
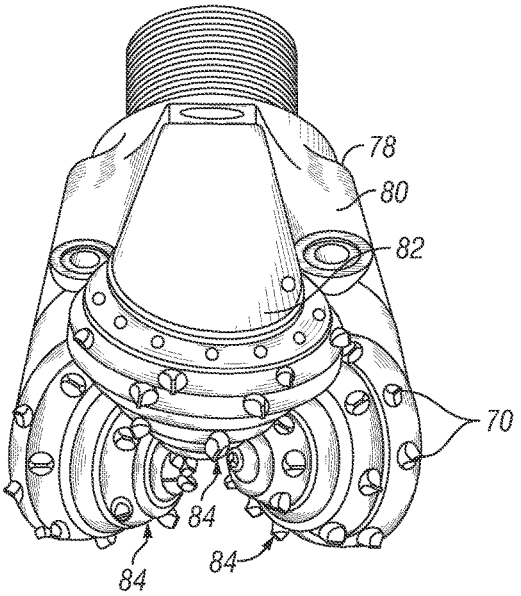
FIG. 6 is a perspective side view of a rotary cone drill bit comprising a number of the inserts of FIG. 5.

FIG. 6 illustrates a rotary or roller cone drill bit in the form of a rock bit 78 comprising a number of the wear or cutting inserts 70 disclosed above and illustrated in FIG. 5. The rock bit 78 comprises a body 80 having three legs 82, and a roller cutter cone 84 mounted on a lower end of each leg. The inserts 70 may be fabricated according to the method described above. The inserts 70 are provided in the surfaces of each cutter cone 84 for bearing on a rock formation being drilled.

Figure 7:
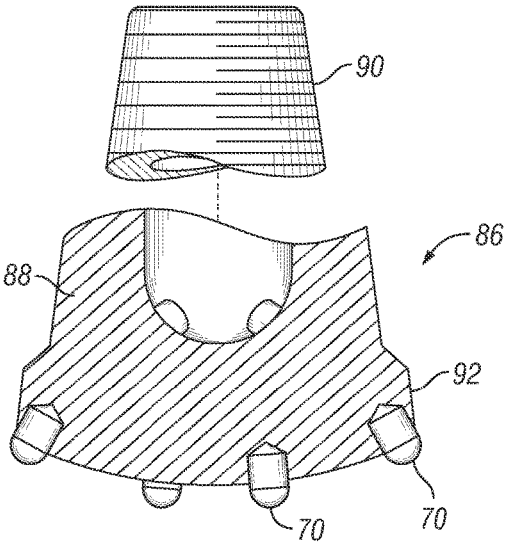
FIG. 7 is a perspective side view of a percussion or hammer bit comprising a number of the inserts of FIG. 5.

FIG. 7 illustrates the inserts 70 described above as used with a percussion or hammer bit 86. The hammer bit comprises a hollow steel body 88 having a threaded pin 90 on an end of the body for assembling the bit onto a drill string (not shown) for drilling oil wells and the like. A plurality of the inserts 70 is provided in the surface of a head 92 of the body 88 for bearing on the subterranean formation being drilled.

Although only a few example embodiments have been described in detail above, those skilled in the art will readily appreciate that many modifications are possible in the example embodiments without materially departing from this disclosure. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed is:

1. An ultra-hard construction comprising:

A diamond body comprising a matrix phase of intercrystalline bonded diamond, and a plurality of interstitial regions dispersed within the matrix phase, wherein the diamond body is formed by subjecting diamond grains to a high-pressure/high-temperature sintering process;

a first metallic substrate attached to the diamond body during formation of the diamond body during the high-pressure/high-temperature sintering process; and a second metallic substrate attached to a surface of the first metallic substrate opposite the diamond body during the high-pressure/high-temperature sintering process used to form the diamond body, the second metallic substrate having an axial thickness greater than that of the first metallic substrate, the first metallic substrate having an unchanged axial thickness upon attachment with the second substrate, and wherein the second metallic substrate is not bonded directly to the diamond body, wherein the first and second substrates are selected from the group consisting of metallic materials, ceramic materials, cermet materials, and combinations of the same, wherein the first and second substrate each comprise a first hard particle phase and a second binder material phase, and wherein the second metallic substrate comprises hard particles having an average particle size that is greater than that of hard particles in the first metallic substrate.

2. The construction as recited in claim 1, wherein the binder phase in the first substrate is selected from the group of consisting of Group VIII elements of the Periodic Table, and wherein such binder phase infiltrates into the diamond body during the high-pressure/high-temperature process to catalyze diamond bonding.

3. The construction as recited in claim 1, wherein one or both of the first and second substrate hard phases comprises a carbide material.

4. The construction as recited in claim 1, wherein the second substrate hard phase material has an average particle size greater than about 10 microns.

5. The construction as recited in claim 1, wherein the second substrate has a thickness that is greater than both the first substrate and the diamond body.

6. A bit for drilling subterranean formations comprising a body and a number of cutting elements operatively attached thereto, wherein one or more of the cutting elements comprises the ultra-hard construction of claim 1.

7. The construction as recited in claim 1, wherein a population of the interstitial regions is substantially free of a catalyst material used to sinter the diamond body at high-pressure/high-temperature conditions.

8. The ultra-hard construction as recited in claim 1 wherein the diamond body has an axial thickness along an outside diameter that is greater than an axial thickness along an inside diameter.

9. The ultra-hard construction as recited in claim 8 wherein the change in thickness between the inside and outside diameters of the diamond body is stepped or gradient.

10. The ultra-hard construction as recited in claim 1, wherein the first substrate comprises an amount of binder material that is greater than the amount of the binder material in the second substrate.

11. A cutting element used with a device for drilling subterranean formations, the cutting element comprising an ultra-hard construction comprising:

an ultra-hard body comprising a matrix phase of bonded-together diamond crystals and a plurality of interstitial regions dispersed within the matrix phase, wherein a catalyst material used to catalyze diamond bonding to form the body from diamond grains at high-pressure/high-temperature sintering conditions is disposed in a population of the interstitial regions;

a first substrate attached to the body and having a material composition comprising hard phase particles and the catalyst material used to catalyze diamond bonding, wherein the body is attached with the first substrate during the body forming high-pressure/high-temperature sintering conditions; and a second substrate attached to a surface of the first substrate opposite the body during the high-pressure/high-temperature sintering conditions, wherein the second substrate comprises hard phase particles that are sized larger than the hard phase particles in the first substrate, wherein the second substrate has an axial thickness greater than the first substrate, wherein the amount of catalyst material in the first substrate is greater than the amount of a binder material in the second substrate, and wherein the body does not directly contact the second substrate.

12. The cutting element as recited in claim 11, wherein the average particle size of the hard particles in the second substrate is greater than about 10 microns.

13. The cutting element as recited in claim 11, wherein the ultra-hard body includes a region comprising interstitial regions substantially free of the catalyst material.

14. A bit for drilling subterranean formations comprising a body and a number the cutting elements as recited in claim 11 operatively attached thereto.

15. A method for making an ultra-hard construction comprising the steps of:

forming a sintered diamond-bonded body by exposing a volume of diamond grains to high-pressure/high-temperature sintering conditions in the presence of a catalyst material provided by a first substrate positioned adjacent the volume of diamond grains, wherein the first substrate comprises a hard phase material;

attaching the first substrate to the diamond-bonded body during the high-pressure/high-temperature sintering conditions used to form the diamond-bonded body, the first substrate having an axial thickness of less than about ½ that of the diamond-bonded body during the step of attaching; and attaching a second substrate to a surface of the first substrate different from a surface of the first substrate attached to the diamond-bonded body during the high-pressure/high-temperature sintering conditions used to form the diamond-bonded body, the second substrate having an axial thickness greater than that of the first substrate during the step of attaching to the first substrate, wherein the second substrate has a hard phase material, wherein the hard phase material in the second substrate has an average particle size greater than the average particle size of the first substrate hard phase material, and wherein the diamond-bonded body does not directly contact the second substrate.

16. The method as recited in claim 15, wherein the second substrate includes a binder material, and wherein the binder material content is less than the content of the catalyst material in the first substrate before the step of forming.

17. The method as recited in claim 15, wherein the second substrate has an axial thickness at the time of attachment with the first substrate that is greater than the combined axial thickness of the diamond-bonded body and the first substrate.

18. The method as recited in claim 15, further comprising the step of removing the catalyst material from at least a region of the diamond-bonded body to render the region substantially free of the catalyst material.

19. The method as recited in claim 15, wherein the ultra-hard body has an axial thickness along an outside diameter that is greater than an axial thickness along an inside diameter.

20. A bit for drilling subterranean formations comprising a plurality of cutting elements, wherein at least one of the cutting elements comprises an ultra-hard construction made according to the method as recited in claim 15.

* * * * *